US009500040B2

(12) United States Patent
Holst et al.

(10) Patent No.: US 9,500,040 B2
(45) Date of Patent: Nov. 22, 2016

(54) BLOWOUT PREVENTER TROLLEY

(71) Applicant: PATTERSON-UTI DRILLING COMPANY LLC, Snyder, TX (US)

(72) Inventors: Katherine J. Holst, Houston, TX (US); Michael F. Jones, Conroe, TX (US); Tyson Andrew Springer, Edmonton (CA); Kristopher Landon Murray Butler, Edmonton (CA); Bradley James Schroeder, Edmonton (CA); Christopher Medland, Edmonton (CA)

(73) Assignee: Patterson-UTI Drilling Company LLC, Houston, TX (US)

( * ) Notice: Subject to any disclaimer, the term of this patent is extended or adjusted under 35 U.S.C. 154(b) by 0 days.

(21) Appl. No.: 14/639,826

(22) Filed: Mar. 5, 2015

(65) Prior Publication Data

US 2016/0258225 A1 Sep. 8, 2016

(51) Int. Cl.
*E21B 15/00* (2006.01)
*E21B 33/06* (2006.01)

(52) U.S. Cl.
CPC ..... *E21B 15/00* (2013.01); *E21B 33/06* (2013.01)

(58) Field of Classification Search
CPC ..... E21B 15/00; E21B 15/003; E21B 33/06
See application file for complete search history.

(56) References Cited

U.S. PATENT DOCUMENTS 3,023,808 A * 3/1962 St John ..... E21B 7/12 175/209
3,498,375 A * 3/1970 Donnally ..... E21B 3/045 166/79.1
3,612,297 A * 10/1971 Lapostolet ..... B65G 49/0459 118/425
3,902,554 A * 9/1975 Hooper ..... E21B 15/02 114/264
4,007,782 A * 2/1977 Nybo ..... E21B 15/02 166/79.1
4,069,785 A * 1/1978 Bordes ..... B63B 35/4413 114/258
4,108,318 A * 8/1978 Rode ..... E21B 19/002 212/307
4,125,164 A * 11/1978 Terry ..... E21B 19/00 166/377
4,249,600 A 2/1981 Bailey
4,759,414 A 7/1988 Willis
4,821,816 A 4/1989 Willis
5,957,431 A * 9/1999 Serda, Jr. ..... B66D 3/18 166/385
6,161,358 A 12/2000 Mochizuki et al.

(Continued)

FOREIGN PATENT DOCUMENTS

WO 2004094774 A1 11/2004

OTHER PUBLICATIONS

PCT International Search Report for PCT International Application No. PCT/US2016/018286, mailed Jul. 20, 2016.

*Primary Examiner* — Matthew R Buck
*Assistant Examiner* — Aaron Lembo
(74) *Attorney, Agent, or Firm* — Holland & Hart LLP

(57) ABSTRACT

A box substructure for a drill rig has a box frame including a medial side oriented towards a space located under a drill floor of the drill rig. A trolley structure is connected to the box frame and protrudes away from the medial side. The trolley structure also has an overhanging end opposite of the medial side.

18 Claims, 6 Drawing Sheets

(56) References Cited

U.S. PATENT DOCUMENTS

| | | | | |
|---|---|---|---|---|
| 6,296,232 | B1 * | 10/2001 | Roodenburg | E21B 19/006 166/355 |
| 7,086,474 | B1 * | 8/2006 | Trevithick | E21B 33/06 166/379 |
| 7,389,820 | B2 | 6/2008 | Day | |
| 7,628,225 | B2 | 12/2009 | Petersson et al. | |
| 8,046,959 | B2 | 11/2011 | Stoetzer et al. | |
| 8,353,132 | B1 | 1/2013 | Vogt et al. | |
| 8,549,815 | B2 | 10/2013 | Donnally et al. | |
| 8,646,240 | B1 | 2/2014 | Patrick et al. | |
| 2004/0231857 | A1 | 11/2004 | Kainer et al. | |
| 2006/0180564 | A1 | 8/2006 | Keppel | |
| 2007/0114039 | A1 | 5/2007 | Hobdy et al. | |
| 2012/0167485 | A1 * | 7/2012 | Trevithick | E21B 15/00 52/112 |
| 2013/0240214 | A1 * | 9/2013 | Faye | E21B 19/002 166/345 |
| 2014/0332487 | A1 | 11/2014 | Boutwell, Jr. | |
| 2015/0068726 | A1 * | 3/2015 | Vogt | E21B 19/00 166/76.1 |

* cited by examiner

BLOWOUT PREVENTER TROLLEY

BACKGROUND

The expense of transporting and setting up drilling rigs at new drill sites can be time consuming and costly. Transporting the equipment for drilling oil and gas wells is often costly because such equipment is heavy and bulky. For example, modular drill rigs often include a mast of over a hundred feet when fully erected, a drilling floor, and a substructure to support the drilling floor and mast. The substructure raises the drilling floor off of the ground at a sufficient height to accommodate equipment connected to the well bore, such as a blowout preventer. The blowout preventer often includes a series of high pressure valves that prevent oil, gas, or water from exiting the well bore when the drill string encounters high pressure regions while drilling through various subterranean formations. Blowout preventers are often ten feet to thirty in height and weigh several tens of thousand pounds.

Transporting the rig generally includes disassembling the components of the drill rig into manageable loads that meet government regulations for transport on truck beds and trailers. At the new drill site, the rigs are assembled in place before the well head equipment is positioned in place. Thus, the blowout preventer is positioned under the drill floor after the drill rig is at least partially assembled. Often, during assembly of the drill rig, hoists and other equipment for handling the blowout preventer into place are transported independent of the substructure and reattached to portions of the drill rig.

One type of rig with a system to position a blowout preventer is disclosed in U.S. Pat. No. 7,389,820 issued to Mark A. Day. In this reference, a blowout preventer system includes a mast functionally connected to a frame assembly and a carriage functionally connected to the mast. The carriage is adapted to carry and support a blowout preventer in a manner such that the blowout preventer may be moved along an angular path and along a plurality of linear paths. The system may further include a mechanism for rotating the blowout preventer along a first rotational path. The system may further include a mechanism for rotating the blowout preventer along a second rotational path.

Other types of systems are described in U.S. Pat. No. 7,628,225 issued to Inge Petersson, et al, and U.S. Pat. No. 6,161,358 issued to David A. Mochizuki, et al. All of these documents are herein incorporated by reference for all that they contain.

SUMMARY

In one aspect of the principles described herein, a box substructure for a drill rig has a box frame including a medial side oriented towards a space located under a drill floor of the drill rig. A trolley structure is connected to the box frame and protrudes away from the medial side. The trolley structure also has an overhanging end opposite of the medial side The trolley substructure may include multiple arms where each of the multiple arms includes a first end pivotally attached to the medial side of the box substructure and a second end pivotally attached to a trolley beam. In some cases, the trolley structure is movable with respect to the box substructure and includes multiple positions. The trolley structure may have a transport position where the multiple arms are aligned with the medial side of the box frame. Also, the trolley structure may have an operating position where the multiple arms are transverse to the medial side of the box frame. A track may be formed in the trolley beam that is aligned with a medial side of the box frame. In some instances, the track is aligned with the medial side of the box frame regardless of whether the trolley structure is in the transport position or the operating position. A hoist may be movably attached to the track.

In some cases, the trolley structure is positioned at a height with respect to ground level that is higher than a blowout preventer standing upright on the ground level. The box substructure may include a hoist connected to the trolley structure. The hoist may be capable of lifting over 2,000 pounds.

In another aspect of the principles described herein, a drill rig includes a first box substructure with a first box frame having a first medial side oriented towards a second box substructure with a second box frame having a second medial side oriented towards the first box substructure. The first box substructure is spaced apart from the second box substructure an overall distance. A first trolley structure is connected to the first box frame and protrudes towards the second box substructure to a first partial distance, and a second trolley structure is connected to the second box frame and protrudes towards the first box substructure to a second partial distance. The first partial distance and the second partial distance are each less than the overall distance, and the first trolley structure is independent of the second trolley structure.

The first trolley structure may include a first arm set and the second trolley structure includes a second arm set where each of the arms in the first set and the second set have a first end pivotally attached to either the first medial side or the second medial side respectively. Also, the arms of the first arm set may include a second end pivotally attached to a first trolley beam, and the arms of the second arm set include a second end pivotally attached to a second trolley beam. The first trolley structure may have a first transport position where the first arm set is aligned with the first medial side of the first box frame. Likewise, the second trolley structure may have a second transport position where the second arm set is aligned with the second medial side of the second box frame. Further, the first trolley structure may have a first operating position where the first arm set is transverse to the first medial side of the first box frame, and the second trolley structure may have a second operating position where the second arm set is transverse to the second medial side of the second box frame.

The drill rig may further have a first track formed in the first trolley beam that is aligned with the first medial side of the first box frame and a second track formed in the second trolley beam that is aligned with the second medial side of the second box frame. A first hoist moveably attached to the first track and a second hoist moveably attached to the second track. In other cases, the first hoist connected to the first trolley structure, and a second hoist connected to a second trolley structure, but not necessarily to a track.

In yet another aspect of the principles described herein, a method for assembling a drill rig includes moving a first trolley structure pivotally connected to a first medial portion of a first box substructure from a first transport position to a first operating position, moving a second trolley structure pivotally connected to a second medial portion of a second box substructure from a second transport position to a second operating position, attaching a blowout preventer to a first hoist moveably connected to a first track of the first trolley structure, attaching the blowout preventer to a second hoist moveably connected to a second track of the second trolley structure, lifting the blowout preventer with the first and second hoists, and guiding the blowout preventer to a position located underneath a drill floor of the drill rig by moving the first hoist along the first track and moving the second hoist along the second track.

In yet an additional aspect of the principles described herein, a drill rig includes a first box substructure with a first box frame having a first medial side oriented towards a second box substructure with a second box frame including a second medial side oriented towards the first box substructure. The first box substructure is spaced apart from the second box substructure an overall distance. A first trolley structure is connected to the first box frame and protrudes towards the second box substructure to a first partial distance, and a second trolley structure is connected to the second box frame and protrudes towards the first box substructure to a second partial distance. The first trolley structure includes a first arm set and the second trolley structure includes a second arm set where arms in the first arm set and the second arm set include a first end pivotally attached to either the first medial side or the second medial side respectively. The arms of the first arm set include a second end pivotally attached to a first trolley beam, and the arms of the second arm set include the second end pivotally attached to a second trolley beam. The first trolley structure has a first transport position where the first arm set is aligned with the first medial side of the first box frame and the second trolley structure has a second transport position where the second arm set is aligned with the second medial side of the second box frame. The first trolley structure has a first operating position where the first arm set is transverse to the first medial side of the first box frame, and the second trolley structure has a second operating position where the second arm set is transverse to the second medial side of the second box frame. A first track is formed in a first trolley beam that is aligned with the first medial side of the first box frame, and a second track formed in a second trolley beam that is aligned with the second medial side of the second box frame. The first partial distance and the second partial distance are each less than the overall distance, and the first trolley structure is independent of the second trolley structure.

Any of the aspects of the principles detailed above may be combined with any of the other aspect detailed herein.

BRIEF DESCRIPTION OF THE DRAWINGS

The accompanying drawings illustrate various embodiments of the present apparatus and are a part of the specification. The illustrated embodiments are merely examples of the present apparatus and do not limit the scope thereof.

Throughout the drawings, identical reference numbers designate similar, but not necessarily identical, elements.

DETAILED DESCRIPTION

Figure 1:
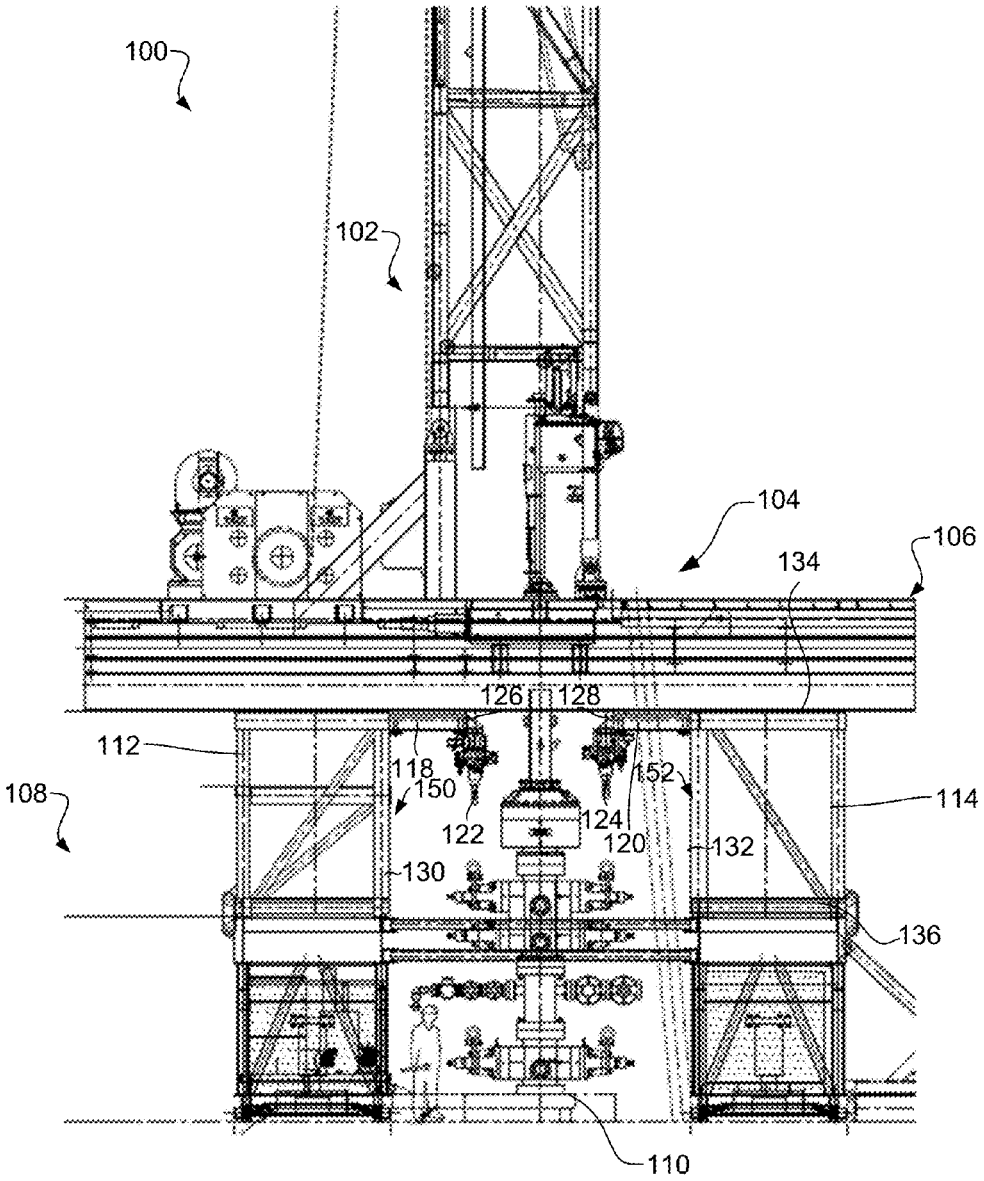
FIG. 1 illustrates a driller's side view of an example of a drill rig with an erected mast in accordance with the present disclosure.

The process of disassembling the components of the drill rig, transporting the drill rig, and reassembling the components of the drill rig are time consuming and costly. Reducing the number of tasks for disassembling and assembling the drill rig can speed up the process of moving the drill rig and thereby make the drill rig more productive and profitable. The principles described in the present disclosure eliminate the task of disconnecting at least some of the structures used to position the blowout preventer over the wellhead. As a consequence, time is saved when assembling the drill rig because the equipment does not have to be reattached. In some examples, the structures described herein can be adjusted so that keeping such equipment attached during transportation conforms with government regulations when the equipment is transported on truck trailers.

For purposes of this disclosure, the term "aligned" means parallel, substantially parallel, or forming an angle of less than 35.0 degrees. Also, for purposes of this disclosure, the term "transverse" means perpendicular, substantially perpendicular, or forming an angle between 55.0 and 125.0 degrees. Further, for purposes of this disclosure, the term "length" refers to the longest dimension of an object.

Particularly, with reference to the figures, FIGS. 1-5 depict a drill rig 100 in accordance with the present disclosure. In these examples, the drill rig 100 includes a mast 102, a drill floor 104, a mast transport skid 106, and a substructure 108. The substructure 108 supports the mast 102, the drill floor 104, and the mast transport skid 106. The substructure 108 raises the drill floor 104 and mast transport skid 106 to an elevation high enough to accommodate a blowout preventer 110 that is positioned over the wellbore.

In the illustrated examples, the substructure 108 includes at least a first box substructure 112 and a second box substructure 114. The box substructures 112, 114 each include a box frame that includes multiple trusses. The substructure 108 supports the weight of the mast 102, the drill floor 104, the mast transport skid 106, the drill string, personnel operating the drill rig 100, and other equipment. Thus, the substructure 108 can be capable of supporting millions of pounds. In some cases, multiple box substructures are placed on top of each other forming a box on box substructure. However, the principles described herein may be used for any appropriate type of substructure including, but not limited to, skid and trailer type substructures, slingshot type substructures, spin-up type substructures, telescope type substructures, modular type structures, other appropriate type substructures, or combinations thereof.

The mast 102 of the drill rig may include multiple sections. In the illustrated examples, the mast 102 includes a lower mast section. The lower mast section includes a driller's side subsection and an off driller's side subsection, which can be separated from each other during disassembly by removing the spreader beams located on the back side of the lower mast section. Additional mast sections, such as top mast sections or middle mast sections can be added to the mast 102. Such additional mast sections can be added to the lower mast section before the lower mast section or after the lower mast section is in an upright position.

The back legs of both of the side subsections of the lower mast assembly may be connected to pivot connections. Such pivot connections may be raised off of the drill floor 104 by pivot supports. In some examples, the pivot supports are rigidly affixed to the mast transport skid 106. As the mast 102 is raised and lowered, the lower mast section may pivot about the pivot connections. The pivot supports may elevate the pivot connections to a height that is 0.5 to 15.0 feet above the drill floor 104 and/or a mast transport skid's surface.

The front mast legs of the lower mast section are attached to front mast leg supports. The front mast legs may form a joint with the front mast leg supports. The front mast leg supports may be attached to front support connectors integrated into the mast transport skid 106. When disconnected from the front support connectors, the front mast leg supports can rotate about the joint. For example, when the lower mast section is lowered into position aligned with the mast transport skid 106, the lower mast assembly may be lowered with the front side down. In such an example, the front mast leg supports remain connected to the front mast legs and therefore travel with the lower mast section. The front mast leg supports can be rotated towards the lower mast section about the joint as the lower mast section is being lowered. As the lower mast section is lowered, the back legs of the lower mast section rotate about the pivot connection. Thus, in the lowered, aligned position, the back legs of the lower mast section are facing upward and are raised off of the mast transport skids 106 by the pivot supports.

In the example of FIG. 1, a cylinder is depicted in the lower mast section. A first end of the cylinder is connected to the lower mast section, and a second end of the cylinder is also shown in the lower mast section. This cylinder may be used to raise and lower the mast by attaching the second end of the cylinder to the mast transport skid 106. With the first end of the cylinder attached to the mast 102 and the second end attached to the mast transport skid 106, the mast 102 can be raised by extending the cylinder. Likewise, the mast 102 can be lowered by retracting the cylinder.

In some examples, the cylinder is a single stage cylinder. Such single stage cylinders generally have a simpler construction and are more robust than multi-stage cylinders. Many modular drill rigs use multi-stage cylinders to raise and lower the mast because the cylinders often need a longer stroke to raise the mast. However, in the illustrated example, the pivot connection of the back legs is raised off of the mast transport skid 106 by 0.5 to 15.0 feet, which reduces the moment on the mast 102 as the mast 102 is raised. As a result, the clear height (the height from the pivot connection to the top of the mast) is low enough that a single stage cylinder is capable of raising the mast 102. In one example where the mast 102 includes the lower mast section, a middle mast section, and a top mast section (not shown), the clear height of the mast may be about 142.0 feet. However, the mast 102 may include any appropriate clear height. For example, the clear height may be between 100.0 and 160.0 feet, another height, or combinations thereof.

After the mast 102 has been oriented in the upright position, the second end of the cylinder may be disconnected from the mast transport skid and refracted into the mast 102. With the cylinder in the retracted position, the cylinder is positioned to be out of the way of drilling operations. For example, leaving the cylinder extended with the cylinder's rod exposed may put the surface material of the cylinder's rod at risk. Some types of drilling mud may chemically react with the chrome of certain cylinder rods and retracting the cylinder into the mast 102 may prevent drilling mud from making contact with the cylinder rod.

A drill string is made of multiple drill pipes and other drill string components threaded together at pipe joints. A drill bit is often secured to the front of the drill sting such that when the drill string is rotated against the formation under a load, a bore hole is formed. The bottom components of the drill string are first lowered through an opening in the blowout preventer 110, which initially guides the drill bit to form the bore hole in the correct location. As the drill bit creates the bore hole, the drill string advances into the formation. Additional drill pipe are added to the drill string as the drill string advances. As the drill string is lengthened by adding more drill pipe, the weight of the drill string increases.

Further, as the drill bit advances through various subterranean formations, the down hole pressures exerted on the drill string change. For example, the drill string may encounter a high pressure pocket of gas or oil trapped within the earth. As such high pressure pockets are punctured by the drill bit, the pressure is released and may exert a force that causes the oil or gas to rapidly move up the bore hole. The blowout preventer 110 is constructed to prevent such oil or other resource from exiting the top of the bore hole. The blowout preventer has multiple types of valves that can be shut to prevent the oil or gas from exiting the bore hole. In some cases, shutting off the values damages the drill pipe. The force exerted by such high pressure pockets can be significant. To counteract such forces, the blowout preventers 110 can weigh over 80,000 pounds. Thus, moving the blowout preventer 110 as a single unit during the drill rig's setup involves the use of equipment that is easy to control and reliable.

In the examples depicted in the figures, a first trolley structure 118 is attached to the first box substructure 112, and a second trolley structure 120 is attached to the second box substructure 114. The trolley structures 118, 120 may be permanently attached to the box substructures 112, 114 including during transportation. A first hoist 122 may be connected to the first trolley structure 118, and a second hoist 124 may be connected to the second trolley structure 120. The hoists 122, 124 may be used to lift and position the blowout preventer 110 and other types of equipment during the assembly and disassembly of the drill rig 100.

In some examples, a first track 126 is formed in the first trolley structure 118, and a second track 128 is formed in the second trolley structure 120. The first and second hoists 122, 124 may be moved along the first and second tracks 126, 128 respectively. The wellbore and therefore the blowout preventer 110 may be positioned within a space between the first and second box substructures 112, 114. For example, a first medial face 130 of a first medial side 150 of the first box substructure 112 may face the space under the drill floor and face towards the desired location of the blowout preventer 110. Further, a second medial face 132 of a second medial side 152 of the second box substructure 114 may also face the space under the drill floor and face towards the desired location of the blowout preventer 110. The first trolley structure 118 may protrude away from the first medial face 130, and the second trolley structure 120 may protrude away from the second medial face 132.

In some circumstances, the first trolley structure 118 may be directly attached to the first medial face, and the second trolley structure 120 may be directly attached to the second medial face 132. However, in other examples, the trolley structures 118, 120 may be attached to different portions of the box substructures 112, 114. For example, the first and second trolley structures 118, 120 may be attached to a top side 134 of the box substructures 112, 114, a bottom side 136 of the box substructures 112, 114, another side of the box substructures 112, 114, or combinations thereof. In one such example, the arms 200 may be long enough to be welded at multiple points across the top, bottom, or other side of the box substructures 112, 114 and protrude beyond the medial faces 130, 132 of the box substructures 112, 114.

The first and second tracks 126, 128 may include any appropriate type of structure for guiding the hoists 122, 124 along their lengths. In one example, at least one of the first and second tracks 130, 132 includes an "I" beam shape with a flange located on an underside of the trolley beam 208, 212. The hoists 122, 124 may be supported, in part, off of the underside flange. A movement mechanism, such as a rack and pinion, may be fastened to or formed in the underside flange to at least partially support the hoists 122, 124. In another example, a lip may be formed in the track to at least partially support the hoists 122, 124.

Figure 2:
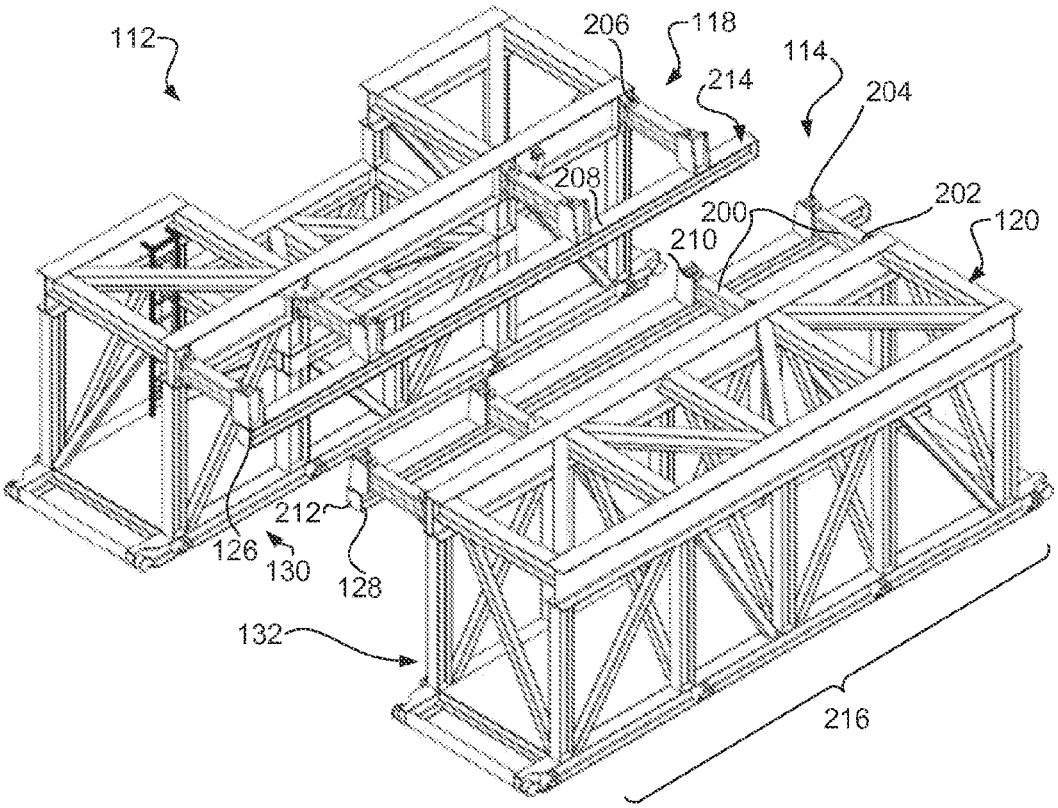
FIG. 2 illustrates a perspective view of an example of a first box substructure and a second box substructure in accordance with the present disclosure.
Figure 4:
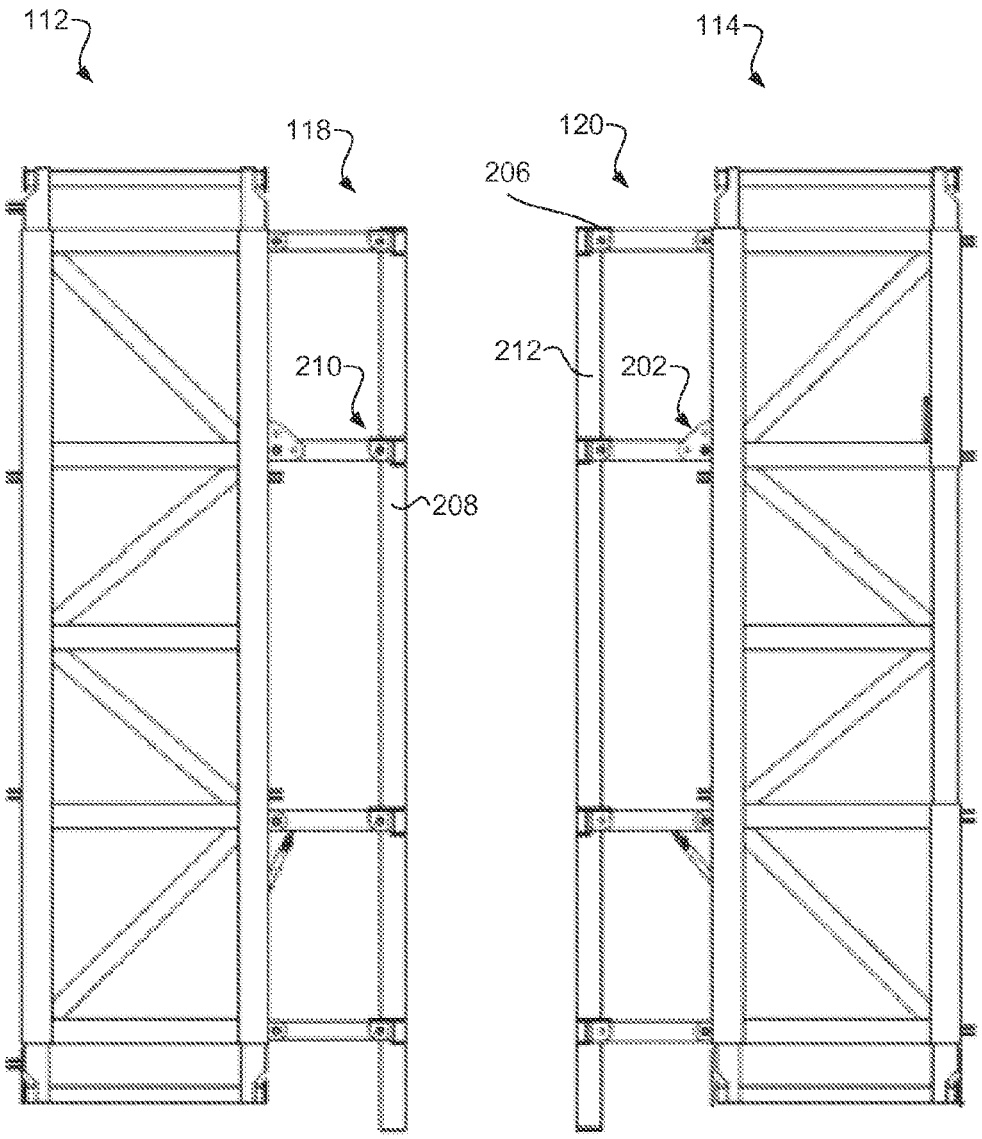
FIG. 4 illustrates a top view of an example of a first box substructure and a second box substructure in accordance with the present disclosure.
Figure 5:
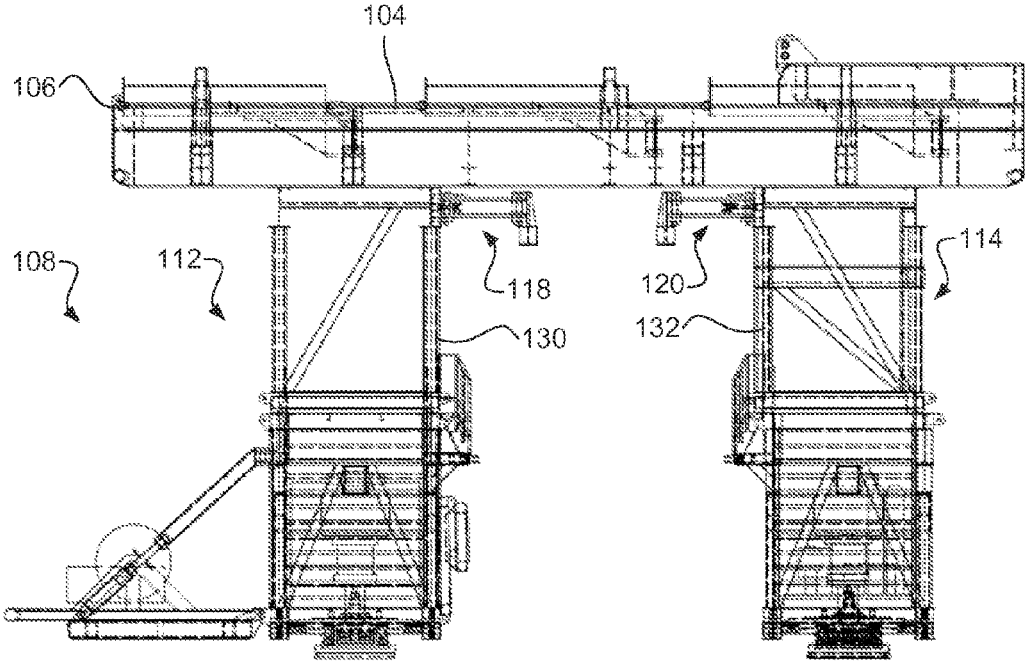
FIG. 5 illustrates an off-driller's side view of an example of a drill rig without a mast in accordance with the present disclosure.

FIGS. 2 and 4 depict examples of the first and second box substructures 112, 114 with multiple arms 200 attached to the box substructure 112, 114 at a first end 202. In some examples, the connection between the first end 202 of the arms 200 and the box substructures 112, 114 is an adjustable connection. For example, such a connection may be a pivot connection where a pivot rod 206 links the arms to the medial faces 130, 132 of the first and second box substructures 112, 114.

The arms 200 of the first trolley structure 118 may also be connected to a first trolley beam 208 on a second end 210, and the arms 200 of the second trolley structure 120 may be connected to the second trolley beam 212 on their second end 210. The connection between the second end 210 of the arms 200 and the first and second trolley beams 208, 212 respectively may be a pivot connection. In the examples depicted in FIGS. 2 and 4, the trolley beams 208, 212 are aligned with the first and second medial faces 130, 132 of the box substructures 112, 114 when in the operating position.

In the operating position, the arms 200 are extended such that the first and second trolley beams 208, 212 are spaced apart at a distance away from the first and second medial faces 130, 132. In this position, the arms 200 are transverse the first and second medial faces 130, 132. While not shown in FIGS. 2 and 4, the hoists 122, 124 may be connected to the trolley beams 208, 212 and may move along the length of the trolley beams 208, 212.

The hoists 122, 124 may be any appropriate device that can travel along the trolley beams 208, 212 and can lift and/or lower loads. Any appropriate hoist may be used in accordance with the principles described in the present disclosure. For example, at least one of the hoists may be a drum type hoist or a lift-wheel type hoist. The hoist may include a lifting medium, such as a rope, a chain, a belt, a fiber, a wire, or another type of lifting medium for attaching to the blowout preventer, or other type of equipment. Such hoists may be operated with any appropriate powering mechanism, such as an electrical mechanism, a hydraulic mechanism, a pneumatic mechanism, a manual mechanism, another type of mechanism, or combinations thereof. The blowout preventer 110 or other type of load may be attached to the lift medium with lifting hooks, straps, belts, fasteners, other types of securing mechanisms, or combinations thereof.

In some examples, the first and second trolley beams 208, 212 are positioned at an elevation that is higher than lifting lugs installed on the blowout preventer 110 above the center of gravity of the stacked assembly. In such an example, the hoists 122, 124 can be positioned above the blowout preventer 110 so that the blowout preventer 110 can be suspended in the air from the hoists 122, 124.

The tracks 126, 128 may extend out one end 214 of the substructures 112, 114 to allow the hoists 122, 124 to be positioned to lift equipment off of transport skids and/or vehicles. In one example, the hoists 122, 124 may be moved to the extended portion of the tracks 126, 128 to attached to a blowout preventer 110 on a transport skid. In such an example, the blowout preventer 110 may be oriented on the transport skid in a horizontal transport position when the hoists 122, 124 are first connected to the blowout preventer 110. As the hoists 122, 124 retract their cables or other type of lifting media, the blowout preventer 110 is raised to a vertical position on the transport skid. In the vertical position, the hoists 122, 124 and trolley structures are ready to take the full load of the blowout preventer 110.

The hoists 122, 124 may be moved along the length of the trolley beams 208, 212 to center the blowout preventer 110 over the wellbore or other desired locations. In addition to centering the blowout preventer over the wellbore with respect to the length of the trolley beams 208, 212, the hoists may also lengthen or retract their lifting mediums to center the blowout preventer 110 with respect to the distance between the box substructures 112, 114. In some cases, the blowout preventer 110 is centered over the wellbore with respect to the trolley beams' lengths first and then centered with respect to the distance between the first and second box substructures 112, 114. However, in other examples, the blowout preventer 110 is centered over the wellbore with respect to the distance between the box substructures 112, 114 before centering the blowout preventer 110 with respect to the trolley beams' lengths. However, in yet another example, the blowout preventer 110 is centered with respect to the distance between the box substructures 112, 114 and along the length of the trolley beams 208, 212 simultaneously. In some cases, when the blowout preventer 110 is centered as desired or as the blowout preventer 110 is being centered as desired, the blowout preventer 110 is lowered by lengthening the lifting medium of the hoists 122, 124 until the blowout preventer 110 rests upon its intended support structure.

The hoists 122, 124 may be controlled with an appropriate mechanism. For example, the hoists 122, 124 may be moved along the length of the trolley beams 208, 212 with a motor that rotates a gear that engages a rack formed in the tracks 126, 128. In other examples, the first and second hoists 122, 124 are moved with a hydraulic mechanism, a pneumatic mechanism, an electric mechanism, a magnetic mechanism, a pulley system, a manual mechanism, another type of mechanism, or combinations thereof. Further, the hoists 122, 124 may be controlled remotely. In such examples, the remote controller may be in communication with the controllers of the hoists 122, 124 through a hard wired communication cable, a wireless mechanism, or combinations thereof.

To transition the trolley structures 118, 120 from the operating position depicted in FIGS. 2 and 4 to the transport position, the arms 200 may be rotated about the pivots of the connections at the arms' first and second ends 202, 210 so that the trolley beams 208, 212 move closer to the box substructures 112, 114. In the transport position, the arms 200 may be aligned with the medial faces 130, 132 of the box substructures 112, 114. Further, in the transport position, the trolley beams 208, 212 may also be aligned with the medial faces 130, 132. When disassembling the drill rig 100, the mast transport skid 106 may be disconnected from the box substructures 112, 114. Further, the box substructures may be disconnected from other box substructures to which they may be connected to during the operation of the drill rig 100. Thus, just the first box substructure 112 and the first trolley structure 118 form a first transportable load, and just the second box substructure 114 and the second trolley structure 120 form a second transportable load. With the trolley structures 118, 120 in the transport positions, the first and second transportable loads may be individually carried by trailers to the next drill site.

By merely moving the first and second trolley structures 118, 120 into the transport position without disconnecting the trolley structures 118, 120 from the box substructures 112, 114, time is saved during disassembly of the drill rig 100. Further, time is saved on the assembly of the drill rig 100 because a trolley system, crane, or another type of system to move the blowout preventer 110 does not have to been reconnected to the drill rig 100. Thus, the principles described herein save significant assembly and disassembly time making the drill rig 100 more profitable.

In some examples, locks are incorporated into the trolley structures 118, 120 so that the arms 200 and/or trolley beams 208, 212 can be locked in place. For example, the locks may lock the arms 200 and trolley beams 208, 212 in place during transport. In other examples, the locks may prevent the arms 200 and trolley beams 208, 212 from moving from out of the operating position while hoists 122, 124 are moving the blowout preventer 110.

In some situations, the trolley structures 118, 120 remain in the operational position while drilling activities are performed on the drill rig 100. In other examples, the trolley structures 118, 120 are moved into the transport position at any time that the trolley structures 118, 120 are not being used to move the blowout preventer 110 or to move other types of equipment. In such examples, the trolley structures 118, 120 may be moved into the transport position while the drill rig 100 is operational, but not moving equipment like the blowout preventer 110.

While the examples above have been described with the trolley structures 118, 120 being supported on just one side to the box substructures 112, 114 with the trolley structure's other side being unsupported, some examples include additional features that provide additional support. For example, a brace may be positioned under at least a portion of the trolley structure 118, 120, such as the trolley beams 208, 212 or arms 200, to provide additional support to the trolley structure 118, 120, especially when hoisting heavy loads. Such a brace may rest on the ground, on a support structure placed on the ground, another portion of the substructure, or combinations thereof. In other examples, a hanger may be attached to any appropriate portion of the trolley structure 118, 120 at one end and the hanger's other end attached to the drill floor 104, mast transport skid 106, or another structure to provide additional support to the cantilevered end of the trolley structure 118, 120.

Further, in some examples, the trolley beam 208, 212 may be supported by features of the box substructure 112, 114 when in the transport position. For example, the trolley beam 208, 212 may fit into a recessed area of the medial face of another portion of the box substructure when in the transport position. Such a recess may protect the trolley beam 208, 212 while the box substructure and trolley structure are being transported together. However, in some examples, the trolley beam 208, 212 does not receive additional support in the transport position, the operating position, or combinations thereof.

Figure 3:
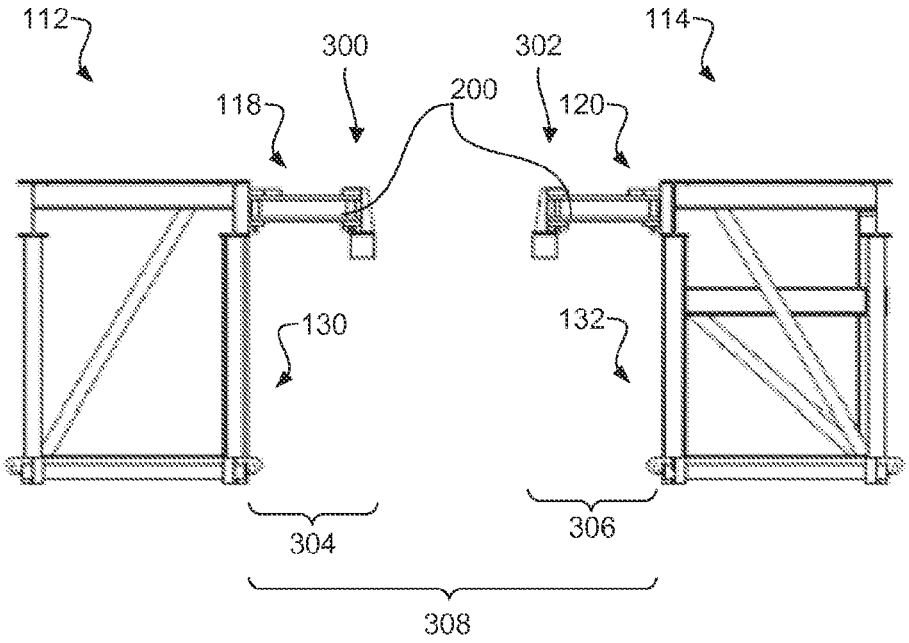
FIG. 3 illustrates an end view of an example of a first box substructure and a second box substructure in accordance with the present disclosure.

FIG. 3 depicts an end view of the first and second substructures 112, 114 with their corresponding first and second trolley structures 118, 120. The first trolley structure 112 has a first overhanging end 300, and the second trolley structure 120 has a second overhanging end 302. The first overhanging end 300 spans a first partial distance 304 from the first box substructure 112, and the second overhanging end 302 spans a second partial distance 306 from the second box substructure 120. In this example, the first partial distance 304 and the second partial distance 306 are each less than an overall distance 308 that separates the first and second box substructures 112, 114.

Figure 6:
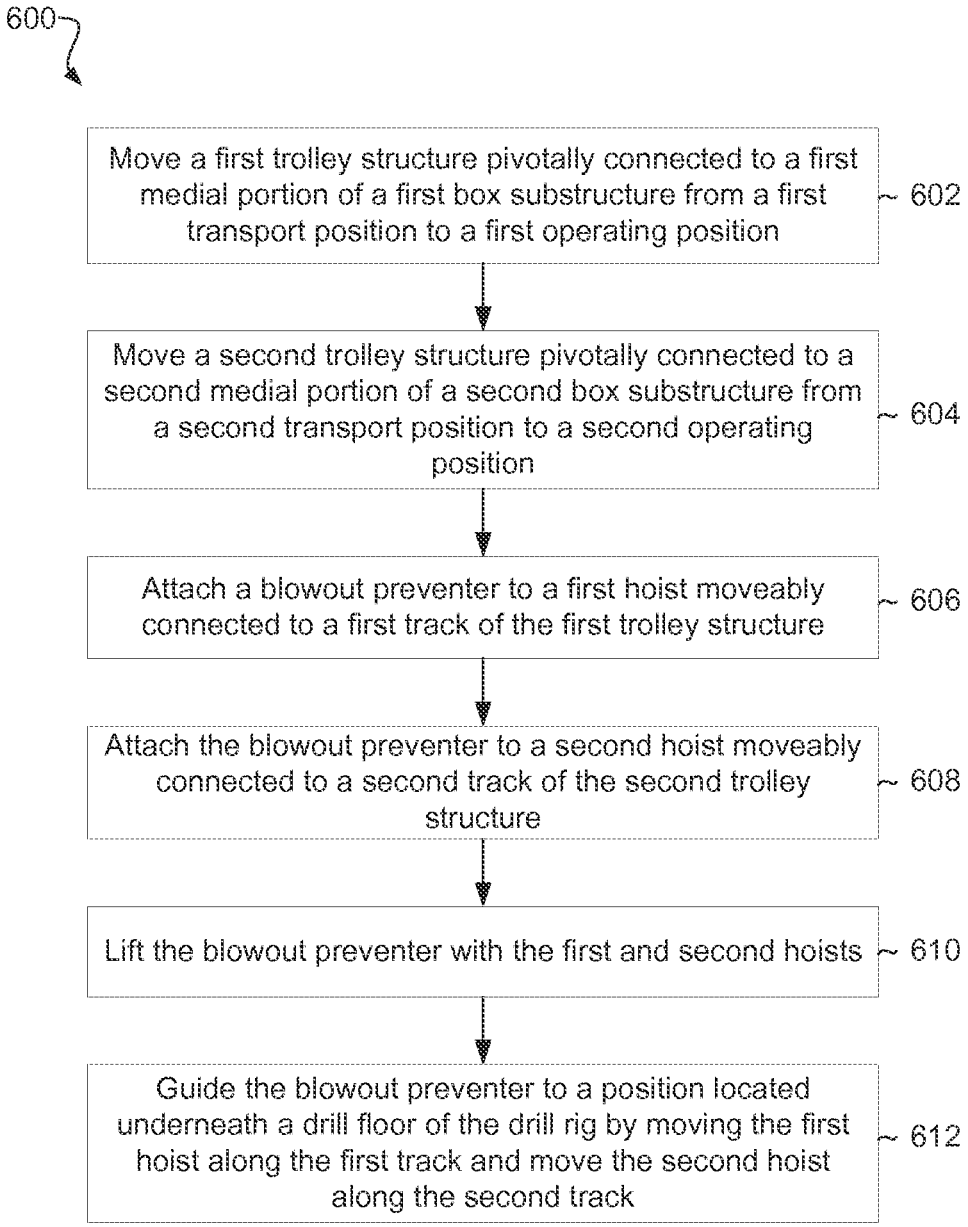
FIG. 6 illustrates a method of an example of assembling a drill rig in accordance with the present disclosure.

FIG. 6 illustrates a method 600 of an example of assembling a drill rig in accordance with the present disclosure. In this example, the method 600 includes moving 602 a first trolley structure pivotally connected to a first medial portion of a first box substructure from a first transport position to a first operating position, moving 604 a second trolley structure pivotally connected to a second medial portion of a second box substructure from a second transport position to a second operating position, attaching 606 a blowout preventer to a first hoist moveably connected to a first track of the first trolley structure, attaching 608 the blowout preventer to a second hoist moveably connected to a second track of the second trolley structure, lifting 610 the blowout preventer with the first and second hoists, and guiding 612 the blowout preventer to a position located underneath a drill floor of the drill rig by moving the first hoist along the first track and moving the second hoist along the second track.

At blocks 602, 604, the trolley structures are moved into their respective operating positions. These operating positions may include moving the trolley beams away from the box substructures so that the trolley beams are spaced apart by a distance away from the medial face of the box substructures. In some examples, the arms that connect one side of the trolley structures are pivotally connected to the box substructure, and the arms are also pivotally connected to the trolley beam. Thus, as each of the multiple arms are pivoted closer to the box substructure, the trolley beam may remain aligned with the medial face of the box substructure while transitioning from the transport position to the operating position. Moving the first trolley structure into the transport position may occur before moving the second trolley structure into the transport position, or vice versa. In other examples, the first and second trolley structures are moved into the operating position simultaneously. Moving the trolley structures from an operating to transport position and vice versa may be done though any appropriate mechanism. For example, the trolley structures may be moved from one position to another manually or with a mechanism like a hydraulic cylinder, a winch, a pulley, a pneumatic mechanism, a hydraulic mechanism, another type of mechanism, or combinations thereof.

At blocks 606, 608, the blowout preventer is attached to the first and second hoists respectively. Each of the hoists may be connected to the first and second tracks formed in or supported by the trolley beams or another portion of the trolley structures. The hoists may be connected sequentially or both of the hoists may be connected simultaneously.

At block 610, the blowout preventer is lifted by the hoists by retracting the lifting media of the hoists. If the first and second trolley structures are not located at the same distance from the well head, the hoists may let out different amounts of the lifting medium to center the blowout preventer between the first and second box substructures.

At block 612, the blowout preventer is guided to a position located underneath the drill floor by moving the hoists along their respective tracks. In some cases, the blowout preventer is centered over the desired location for forming a well or over an existing well. The hoists may be moved along the tracks with any appropriate driving mechanism, such as hydraulic actuators, pneumatic actuators, motors, linear actuators, gears, racks and pinions, rollers, pulleys and cables, chains, other mechanisms, or combinations thereof. The blowout preventer may be lowered into the desired position by lengthening the lifting media of the hoists.

While the substructures, drill rigs, and methods have been described above with reference to specific details, such substructures, drill rigs, and methods may include alternative features and tasks in accordance with the principles described in the present disclosure. For example, at least one of the box substructures may include multiple trolley structures. The additional trolley structures may be advantageous by distributing the amount of weight of the blowout preventer or other load across additional trolley structures. Additionally, the trolley structure may include multiple tracks that are aligned with each other that can support additional hoists. In this example, the same weight may be loaded to the same trolley structure, but the weight may be distributed across more hoists to reduce the load per hoist. While the examples above have been described with reference just a first and a second hoist, any number of hoists may be used. For example, more than one hoist may be positioned on the first and second tracks. In such examples, the additional hoists may be connected to the blowout preventer at the same height. However, in other examples, the lifting media of the hoists may be connected to the blowout preventer at different heights to give more control when positioning the blowout preventer over the well head. For example, a first set of lifting media may be used to lift the blowout preventer vertically, and a second set of lifting media may be used to angle the blowout preventer at a desirable angle for installation.

What is claimed is:

1. A box substructure for a drill rig, comprising:

a box frame including a medial side oriented towards a space located under a drill floor of the drill rig; and a trolley structure connected to the box frame and protruding away from the medial side;

the trolley structure having an overhanging end opposite the medial side;

the trolley structure having multiple arms where each of the multiple arms includes a first end pivotally attached to the medial side of the box substructure and a second end pivotally attached to a trolley beam.

2. The box substructure of claim 1, wherein the trolley structure comprises a transport position where the multiple arms are aligned with the medial side of the box frame.

3. The box substructure of claim 1, wherein the trolley structure comprises an operating position where the multiple arms are transverse to the medial side of the box frame.

4. The box substructure of claim 1, further comprising a track formed in the trolley beam that is aligned with a medial side of the box frame.

5. The box substructure of claim 4, further comprising a hoist moveably attached to the track.

6. The box substructure of claim 5, wherein the hoist is capable of lifting over 2,000 pounds.

7. The box substructure of claim 1, wherein the trolley structure is positioned at a height with respect to ground level that is higher than a center of gravity of a blowout preventer stack standing upright on the ground level.

8. A drill rig, comprising:

a first box substructure with a first box frame including a first medial side oriented towards a second box substructure with a second box frame including a second medial side oriented towards the first box substructure;

the first box substructure being spaced apart from the second box substructure an overall distance;

a first trolley structure connected to the first box frame and protruding towards the second box substructure to a first partial distance; and a second trolley structure connected to the second box frame and protruding towards the first box substructure to a second partial distance;

wherein the first partial distance and the second partial distance are each less than the overall distance, and the first trolley structure is independent of the second trolley structure; and wherein the first trolley structure includes a first arm set and the second trolley structure includes a second arm set, wherein arms in the first arm set and the second arm set each include a first end pivotally attached to either the first medial side or the second medial side, respectively.

9. The drill rig of claim 8, wherein the arms of the first arm set include a second end pivotally attached to a first trolley beam, and the arms of the second arm set include the second end pivotally attached to a second trolley beam.

10. The drill rig of claim 9, wherein the first trolley structure comprises a first transport position where the first arm set is aligned with the first medial side of the first box frame and the second trolley structure comprises a second transport position where the second arm set is aligned with the second medial side of the second box frame.

11. The drill rig of claim 8, wherein the first trolley structure comprises a first operating position where the first arm set is transverse to the first medial side of the first box frame, and the second trolley structure comprises a second operating position where the second arm set is transverse to the second medial side of the second box frame.

12. The drill rig of claim 8, further comprising a first track formed in a first trolley beam that is aligned with the first medial side of the first box frame and a second track formed in a second trolley beam that is aligned with the second medial side of the second box frame.

13. The drill rig of claim 12, further comprising a first hoist moveably attached to the first track and a second hoist moveably attached to the second track.

14. The drill rig of claim 8, further comprising a first hoist connected to the first trolley structure, and a second hoist connected to the second trolley structure.

15. A method for assembling a drill rig, comprising:

moving a first trolley structure pivotally connected to a first medial portion of a first box substructure with a first plurality of arms from a first transport position to a first operating position; and moving a second trolley structure pivotally connected to a second medial portion of a second box substructure with a second plurality of arms from a second transport position to a second operating position.

16. The method of claim 15, further comprising:

attaching a blowout preventer to a first hoist moveably connected to a first track of the first trolley structure;

attaching the blowout preventer to a second hoist moveably connected to a second track of the second trolley structure;

lifting the blowout preventer with the first hoist and the second hoist; and guiding the blowout preventer to a position located underneath a drill floor of the drill rig by moving the first hoist along the first track and moving the second hoist along the second track.

17. The method of claim 15, wherein the first trolley structure includes a first arm set and the second trolley structure includes a second arm set where arms in the first arm set and the second arm set includes a first end pivotally attached to either the first medial side or the second medial side respectively.

18. A drill rig, comprising:

a first box substructure with a first box frame including a first medial side oriented towards a second box substructure with a second box frame including a second medial side oriented towards the first box substructure;

the first box substructure being spaced apart from the second box substructure an overall distance;

a first trolley structure connected to the first box frame and protruding towards the second box substructure to a first partial distance;

a second trolley structure connected to the second box frame and protruding towards the first box substructure to a second partial distance;

the first trolley structure includes a first arm set and the second trolley structure includes a second arm set where arms in the first arm set and the second arm set include a first end pivotally attached to either the first medial side or the second medial side respectively;

the arms of the first arm set include a second end pivotally attached to a first trolley beam, and the arms of the second arm set include the second end pivotally attached to a second trolley beam;

the first trolley structure comprises a first transport position where the first arm set is aligned with the first medial side of the first box frame and the second trolley structure comprises a second transport position where the second arm set is aligned with the second medial side of the second box frame;

the first trolley structure comprises a first operating position where the first arm set is transverse to the first medial side of the first box frame, and the second trolley structure comprises a second operating position where the second arm set is transverse to the second medial side of the second box frame;

a first track formed in the first trolley beam that is aligned with the first medial side of the first box frame and a second track formed in the second trolley beam that is aligned with the second medial side of the second box frame;

wherein the first partial distance and the second partial distance are each less than the overall distance, and the first trolley structure is independent of the second trolley structure.

* * * * *